US007679567B2

(12) United States Patent
Azhari

(10) Patent No.: US 7,679,567 B2
(45) Date of Patent: Mar. 16, 2010

(54) ANTENNA WITH SERIES STUB TUNING

(75) Inventor: Alexander Azhari, Stockholm (SE)

(73) Assignee: Sony Ericsson Mobile Communications AB, Lund (SE)

( * ) Notice: Subject to any disclaimer, the term of this patent is extended or adjusted under 35 U.S.C. 154(b) by 31 days.

(21) Appl. No.: 11/927,900

(22) Filed: Oct. 30, 2007

(65) Prior Publication Data

US 2009/0102732 A1 Apr. 23, 2009

Related U.S. Application Data

(60) Provisional application No. 60/980,922, filed on Oct. 18, 2007.

(51) Int. Cl.
*H01Q 1/38* (2006.01)
*H01Q 1/50* (2006.01)

(52) U.S. Cl. ..... 343/700 MS; 343/850

(58) Field of Classification Search ..... 343/793, 343/797, 810–820, 846, 702, 700 MS, 873, 343/850

See application file for complete search history.

(56) References Cited

U.S. PATENT DOCUMENTS

| | | | | |
|---|---|---|---|---|
| 6,650,295 | B2 * | 11/2003 | Ollikainen et al. | 343/700 MS |
| 7,119,747 | B2 * | 10/2006 | Lin et al. | 343/702 |
| 2003/0058168 | A1 | 3/2003 | Sadler et al. | |
| 2003/0142022 | A1 | 7/2003 | Ollikainen et al. | |
| 2004/0070537 | A1 | 4/2004 | Kadambi et al. | |

FOREIGN PATENT DOCUMENTS

WO WO 2004/054034 A1 6/2004

OTHER PUBLICATIONS

International Search Report and Written Opinion dated Aug. 13, 2008 issued in corresponding international application No. PCT/IB2008/051464, 12 pages.

* cited by examiner

*Primary Examiner*—Shih-Chao Chen
(74) *Attorney, Agent, or Firm*—Harrity & Harrity, LLP

(57) ABSTRACT

An antenna may include a conductive material formed in a pattern on an antenna housing, where one end of the conductive material connects to a ground connection. The antenna may further include a tuning stub, having a length ($l_0$), connected to the conductive material at a distance ($d_0$) from the ground connection, where the distance ($d_0$) tunes a resonance of the antenna.

12 Claims, 8 Drawing Sheets

ANTENNA WITH SERIES STUB TUNING

CROSS REFERENCE TO RELATED APPLICATION

The instant application claims priority from provisional application No. 60/980,922, filed Oct. 18, 2007, the disclosure of which is incorporated by reference herein in its entirety.

TECHNICAL FIELD OF THE INVENTION

Implementations described herein relate generally to tunable antennas and, more particularly, to tuning a band of an antenna using a series connected stub.

BACKGROUND

In radio communications systems, data is transmitted via electromagnetic waves. The electromagnetic waves are transmitted via antennas, with the carrier frequencies being in the frequency band (or bands) intended for the respective system. In addition to the requirement to restrict the dimensions of the antenna to fit into the small sizes of the mobile radio transmitting and receiving devices, there is also an increasing requirement for the capability to transmit and receive in multiple different frequency bands, thus, giving the mobile radio devices access to greater bandwidth.

Tunable antennas, therefore, are desirable given the current demand for bandwidth in today's mobile radio designs. A planar inverted F-type antenna (PIFA) is one example of a tunable antenna. A typical PIFA antenna may be tuned to have three resonances that correspond to Global System for Mobile Communications (GSM)/Wide Band Code Division Multiple Access (WCDMA) bands. For example, a typical PIFA antenna may have a first resonance with a bandwidth from 824 MHz to 960 MHz at −6 dB (low band) and two other resonances with a bandwidth from 1710 MHz to 2170 MHz at −6 dB (mid and high bands). Each resonance in a PIFA antenna is set by the effective length of the current flow on the antenna pattern surface and can be expressed by:

$$L + W = \frac{\lambda_{air}}{4\sqrt{\varepsilon_{reff}}} \quad \text{Eqn. (1)}$$

where λ is the wavelength in air;

L+W is the two dimensional effective current flow on the antenna pattern; and $\in_{reff}$ is the effective dielectric constant, which can further be expressed by:

$$\varepsilon_{reff} = \frac{\varepsilon_r + 1}{2} + \frac{\varepsilon_r - 1}{2}\left[1 + 12\frac{H}{W}\right]^{-\frac{1}{2}} \quad \text{Eqn. (2)}$$

where $\in_r$ is the dielectric constant of the antenna's substrate.

Tuning down (towards lower frequencies) the third high band resonance of a PIFA antenna can be done, but typically only by adding matching components that reduce the total efficiency of the antenna.

SUMMARY

According to one aspect, an antenna may include conductive material formed in a pattern on an antenna housing, where one end of the conductive material connects to a ground connection. The antenna may further include a tuning stub, having a length ($l_0$), connected to the conductive material at a distance ($d_0$) from the ground connection, where the distance ($d_0$) tunes a resonance of the antenna.

Additionally, the length ($l_0$) of the antenna may further tune the resonance of the antenna.

Additionally, the tuning stub may include an open transmission line, having the length ($l_0$), connected to the conductive material at the distance ($d_0$) from the ground connection.

Additionally, the length ($l_0$) and/or distance ($d_0$) of the tuning stub may be adjusted to tune the resonance of the antenna to a lower frequency.

Additionally, the length ($l_0$) and distance ($d_0$) may tune a high band resonance of the antenna without affecting other resonance bands of the antenna.

Additionally, the length ($l_0$) and distance ($d_0$) may tune a high band resonance of the antenna without affecting antenna matching or effective two dimensional current flow on the antenna.

Additionally, the antenna may include a planar F-type antenna.

According to another aspect, an apparatus may include a transceiver unit and an antenna. The antenna may be connected to the transceiver unit and to a ground connection and may include a tunable stub, having a length ($l_0$), connected to the antenna at a distance ($d_0$) from the ground connection, where a value of the length ($l_0$) and a value of the distance ($d_0$) affect a high band resonance of the antenna without affecting other resonances of the antenna.

Additionally, the tunable stub may include an open transmission line, having the length ($l_0$), connected to the antenna at the distance ($d_0$) from the ground connection.

Additionally, the length ($l_0$) and/or distance ($d_0$) of the tunable stub may be adjusted to tune the high band resonance of the antenna to a lower frequency.

Additionally, the antenna may include a planar F-type antenna.

Additionally, the apparatus may include a cellular radiotelephone.

According to a further aspect, an antenna may include a conductive material formed in a pattern on an antenna housing, where one end of the conductive material connects to a ground connection. The antenna may further include a tuning stub, having a length ($l_0$) and comprising an open transmission line, connected to the conductive material at a distance ($d_0$) from the ground connection, where the distance ($d_0$) and length ($l_0$) can be adjusted to tune a high band resonance of the antenna without affecting other resonance bands of the antenna.

It should be emphasized that the term "comprises/comprising" when used in this specification is taken to specify the presence of stated features, integers, steps, components or groups but does not preclude the presence or addition of one or more other features, integers, steps, components or groups thereof.

BRIEF DESCRIPTION OF THE DRAWINGS

The accompanying drawings, which are incorporated in and constitute a part of this specification, illustrate one or more embodiments of the invention and, together with the description, explain the invention. In the drawings.

DETAILED DESCRIPTION OF EMBODIMENTS

The following detailed description of the invention refers to the accompanying drawings. The same reference numbers in different drawings may identify the same or similar elements. Also, the following detailed description does not limit the invention.

As described herein, a tunable stub may be series connected to an antenna, such as, for example, a PIFA antenna or a semi-PIFA antenna, so that a high band resonance of the antenna may be tuned independently of other resonances of the antenna. The tunable stub may include a section of open transmission line connected to the antenna at a distance $d_0$ from the antenna's ground connection. Additionally, the tunable stub may have a stub length $l_0$. The stub position $d_0$ and stub length $l_0$ of the stub may be adjusted to tune the high band resonance of the antenna. For example, the stub position $d_0$ and/or stub length $l_0$ of the stub may be adjusted (i.e., increased and/or decreased) to tune the high band resonance towards lower frequencies. Tuning the high band resonance of the antenna using a tunable stub, as described herein, may be accomplished without affecting the antenna L+W, the antenna matching, or without affecting the other resonances of the antenna (e.g., low or mid band resonances).

Figure 1:
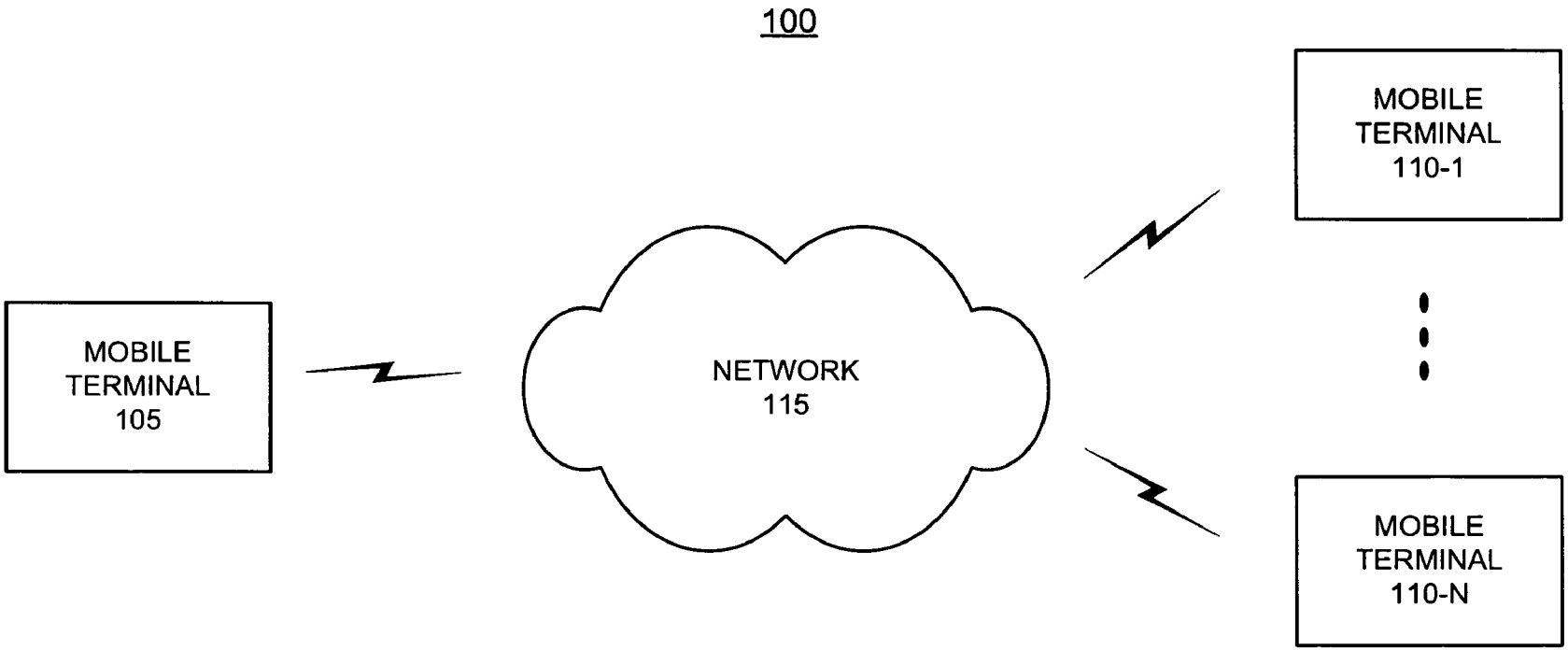
FIG. 1 illustrates an exemplary system in which aspects of the invention may be implemented.

FIG. 1 illustrates an exemplary system 100 in which aspects of the invention may be implemented. System 100 may include mobile terminal 105 connected with mobile terminals 110-1 through 110-N via network 115 using wireless links. Network 115 may include one or more networks of any type, including a local area network (LAN); a wide area network (WAN); a metropolitan area network (MAN); a satellite network; a telephone network, such as the Public Switched Telephone Network (PSTN) or a Public Land Mobile Network (PLMN); an intranet, the Internet; or a combination of networks. The PLMN(s) may further include a packet-switched sub-network, such as, for example, General Packet Radio Service (GPRS), Cellular Digital Packet Data (CDPD), or Mobile IP sub-network.

Mobile terminals 105 and 110-1 through 110-N may be similarly constructed and may include telephones, cellular radiotelephones, Personal Communications System (PCS) terminals or the like. PCS terminals may combine a cellular radiotelephone with data processing, facsimile and data communications capabilities. Mobile terminals 105 and 110-1 through 110-N may further include personal digital assistants (PDAs), conventional laptops and/or palmtop receivers, or other appliances that include radiotelephone transceivers, or the like. PDAs may include radiotelephones, pagers, Internet/intranet access, web browsers, organizers, calendars and/or global positioning system (GPS) receivers. Mobile terminals 105 and 110-1 through 110-N may further be referred to as "pervasive computing" devices.

Figure 2:
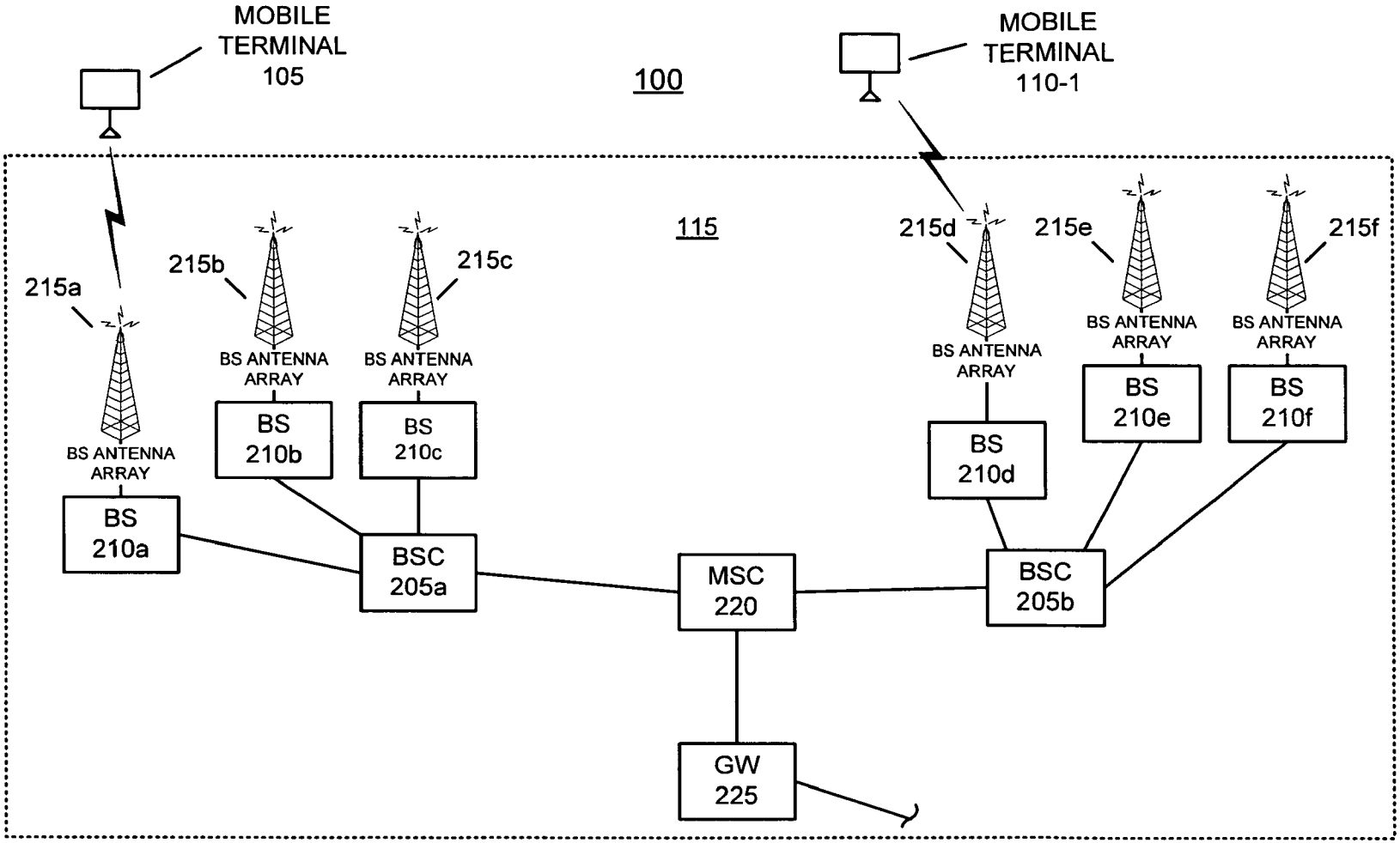
FIG. 2 illustrates an exemplary system that includes a public land mobile network.

FIG. 2 illustrates one example of system 100 implemented using a PLMN. System 100 may include mobile terminals 105 and 110-1 and PLMN 115. PLMN 115 may include one or more base station controllers (BSCs) 205*a*-205*b*, multiple base stations (BSs) 210*a*-210*f*, multiple base station antenna arrays 215*a*-215*f*, one or more mobile switching centers (MSCs), such as MSC 220, and one or more gateways (GWs), such as GW 225.

PLMN 115 may include components used for transmitting data to and from mobile terminals 105 and 110-1 through 110-N. Such components may include base station antenna arrays 215*a*-215*f*, which transmit and receive, via appropriate data channels, data from mobile terminals within their vicinity. Base stations 210*a*-210*f* connect to their respective antenna arrays 215*a*-215*f*, and format the data transmitted to, or received from the antenna arrays 215*a*-215*f* in accordance with existing techniques, for communicating with BSCs 205*a*-205*b* or a mobile terminal, such as mobile terminal 105. Among other functions, BSCs 205*a*-205*b* may route received data to either MSC 220 or a base station (e.g., BS's 210*a*-210*c* or 210*d*-210*f*). MSC 220 routes received data to BSC 205*a* or 205*b*. GW 225 may route data received from an external domain (not shown) to an appropriate MSC (such as MSC 220), or from an MSC to an appropriate external domain.

Figure 3:
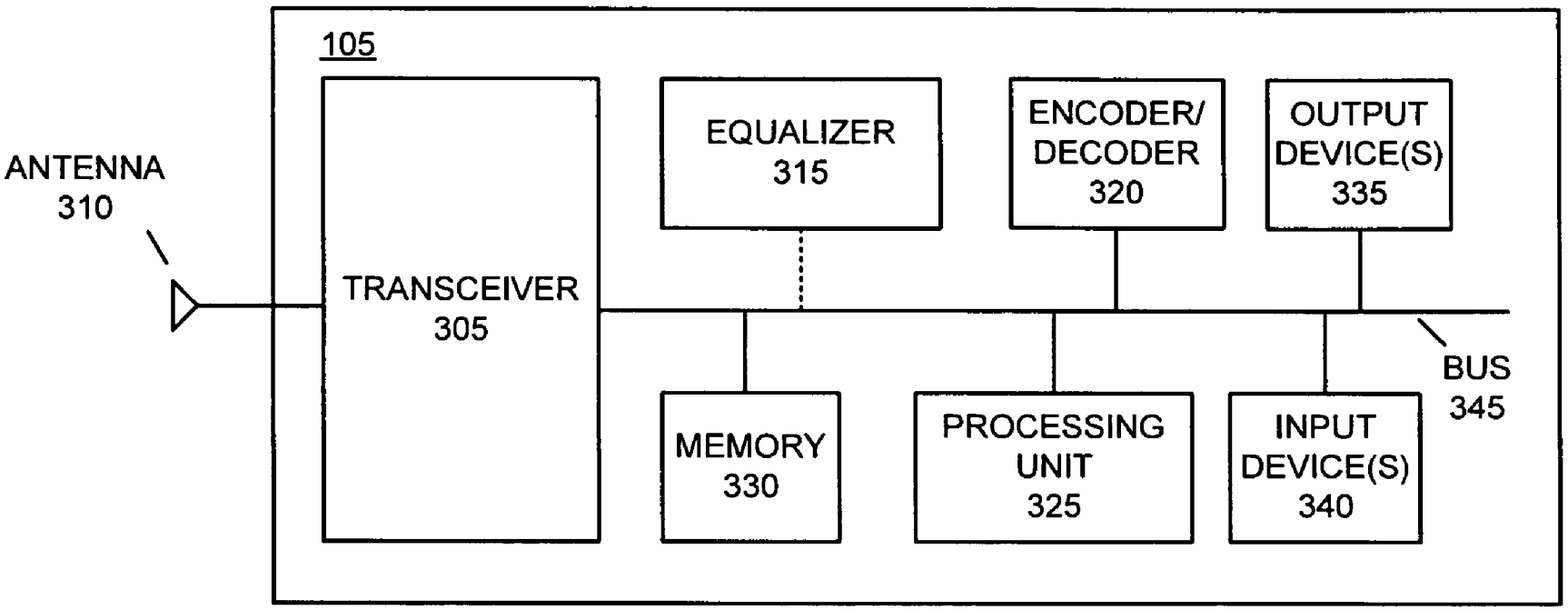
FIG. 3 illustrates a mobile terminal according to an exemplary implementation.

FIG. 3 illustrates mobile terminal (MT) 105 according to an exemplary implementation. Mobile terminals 110-1 through 110-N may be similarly configured. Mobile terminal 105 may include a transceiver 305, an antenna 310, an equalizer 315, an encoder/decoder 320, a processing unit 325, a memory 330, an output device(s) 335, an input device(s) 340, and a bus 345.

Transceiver 305 may include transceiver circuitry for transmitting and/or receiving symbol sequences in a network, such as network 115, via antenna 310. Transceiver 305 may include, for example, a conventional RAKE receiver. Transceiver 305 may further include mechanisms for estimating the signal-to-interference ratio (SIR) of received symbol sequences. Transceiver 305 may additionally include mechanisms for estimating the propagation channel Doppler frequency. Antenna 310, as described below, may include a series connected stub that permits a high band resonance of antenna 310 to be tuned independently of other resonances of antenna 310.

Equalizer 315 may store and implement Viterbi trellises for estimating received symbol sequences using, for example, a maximum likelihood sequence estimation technique. Equalizer 315 may additionally include mechanisms for performing channel estimation.

Encoder/decoder 320 may include circuitry for decoding and/or encoding received or transmitted symbol sequences. Processing unit 325 may perform all data processing functions for inputting, outputting, and processing of data including data buffering and terminal control functions, such as call processing control, user interface control, or the like. Memory 330 provides permanent, semi-permanent, or temporary working storage of data and instructions for use by processing unit 325 in performing processing functions. Memory 330 may include large-capacity storage devices, such as a magnetic and/or optical recording medium and its corresponding drive. Output device(s) 335 may include mechanisms for outputting data in video, audio, and/or hard copy format. Input device(s) 340 permit entry of data into mobile terminal 105 and may include a user interface and a microphone (not shown). The microphone can include mechanisms for converting auditory input into electrical signals. Bus 345 interconnects the various components of mobile terminal 105 to permit the components to communicate with one another. The configuration of components of mobile terminal 105 illustrated in FIG. 3 is for illustrative purposes only. One skilled in the art will recognize that other configurations may be implemented, or other (possibly different) components than those shown in FIG. 3 may be used.

Figure 4A:
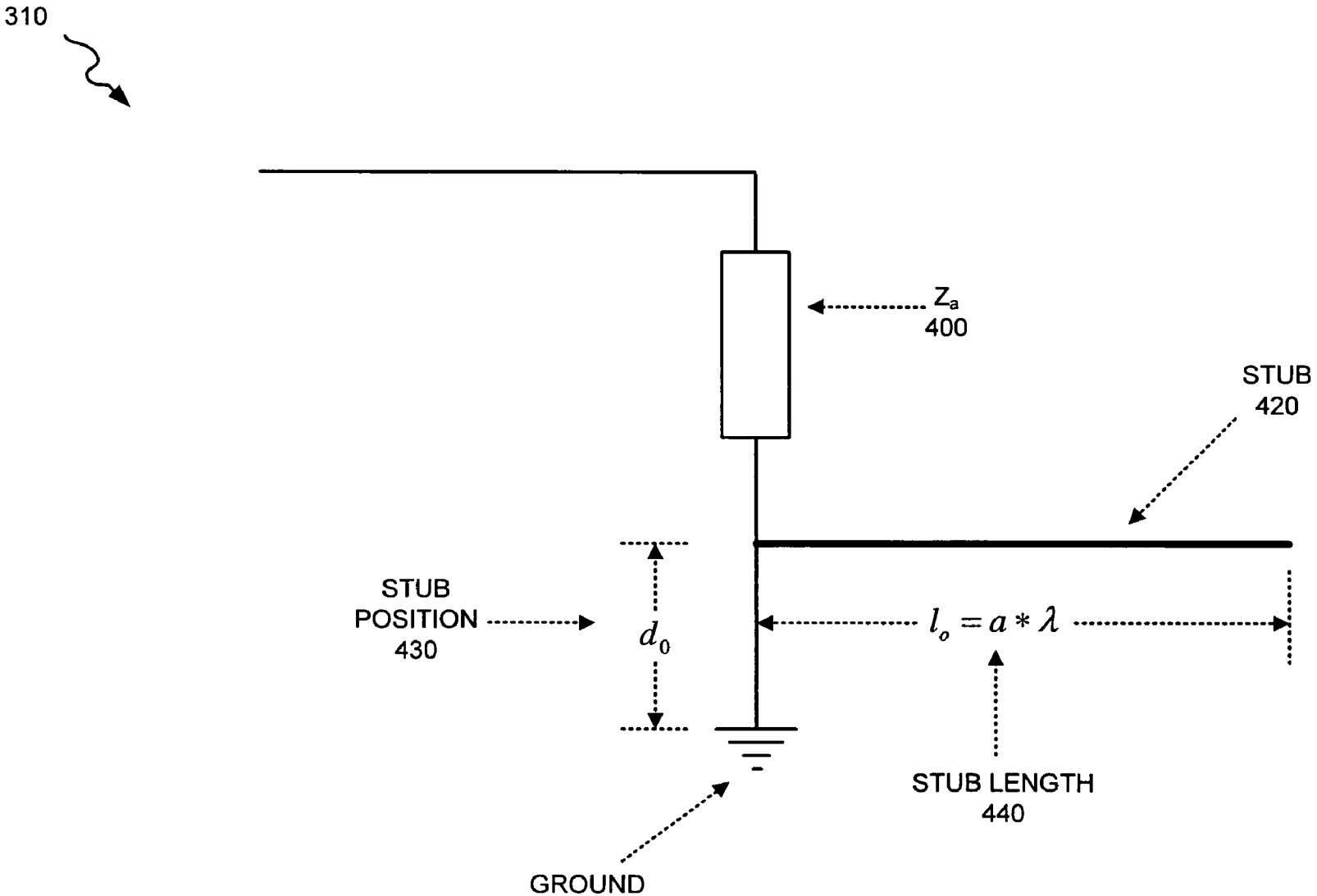
FIGS. 4A and 4B illustrate a schematic representation of the antenna of FIG. 3.
Figure 4B:
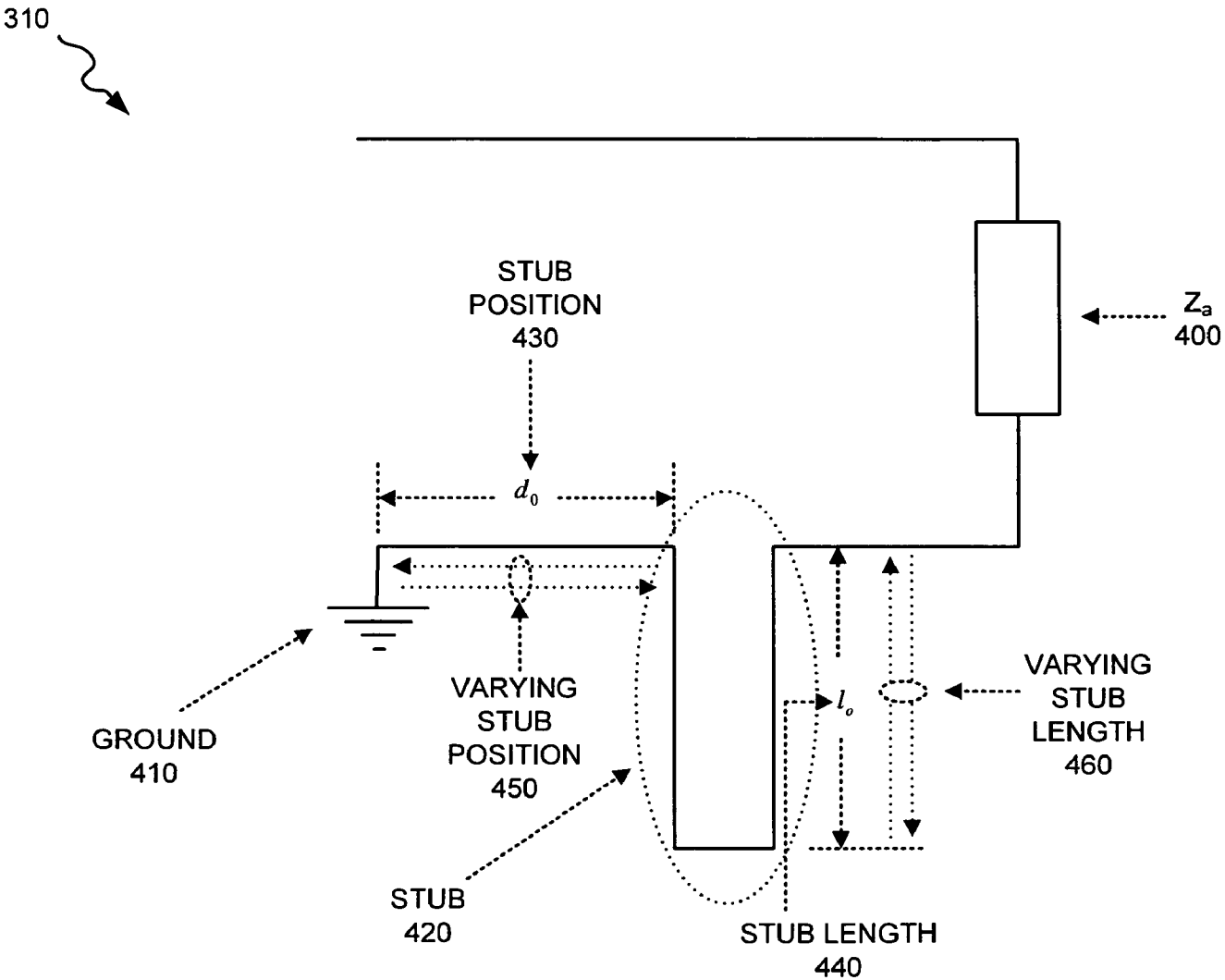

FIGS. 4A and 4B illustrate schematic representations of antenna 310. As depicted in FIG. 4A, antenna 310 may have a characteristic impedance Za 400, shown connected to ground 410. A stub 420 may further be series connected to antenna 310 at a stub position 430 that is a distance $d_0$ from ground 410. In one implementation, stub 420 may include a section of open transmission line connected at stub position 430. As shown in FIG. 4A, stub 420 may have a stub length 440. The length ($l_0$) of stub 420 may be equal to:

$$l_o = a*\lambda \qquad \text{Eqn. (3)}$$

where $\lambda$ is the wavelength; and a is a constant that may be varied.

Connecting stub 420 at stub position 430 ($d_0$) in series changes the antenna's input impedance as a function of stub length 440 ($l_0$).

FIG. 4B illustrates another schematic representation of antenna 310. FIG. 4B depicts stub 420, series connected with impedance Za 400 of antenna 310, having a stub position 430 ($d_0$) relative to ground 410 and a stub length 440 ($l_0$). As shown in FIG. 4B, stub position 430 ($d_0$) may be varied 450 (e.g., moved closer to or away from ground 410) and stub length 440 ($l_0$) may also be varied 460 (e.g., shortened or lengthened) to tune the antenna high band resonance. For example, stub position 430 ($d_0$) may be varied (e.g., $d_0$ increased or decreased) and stub length 440 ($l_0$) may be held constant, stub position 430 ($d_0$) may be held constant and stub length 440 ($l_0$) may be varied (e.g., $l_0$ increased or decreased), or stub position 430 ($d_0$) and stub length 440 ($l_0$) may both be varied, to find optimum values for tuning the antenna high band resonance. Optimum values of stub position 430 ($d_0$) and stub length 440 ($l_0$), for a desired high band antenna resonance, may be found through performance testing of antenna 310. Varying stub position 430 ($d_0$) and/or stub length 440 ($l_0$) may tune the high band resonance towards lower frequencies without affecting antenna L+W, antenna matching or other antenna resonances (e.g., low or mid band resonances).

Figure 5:
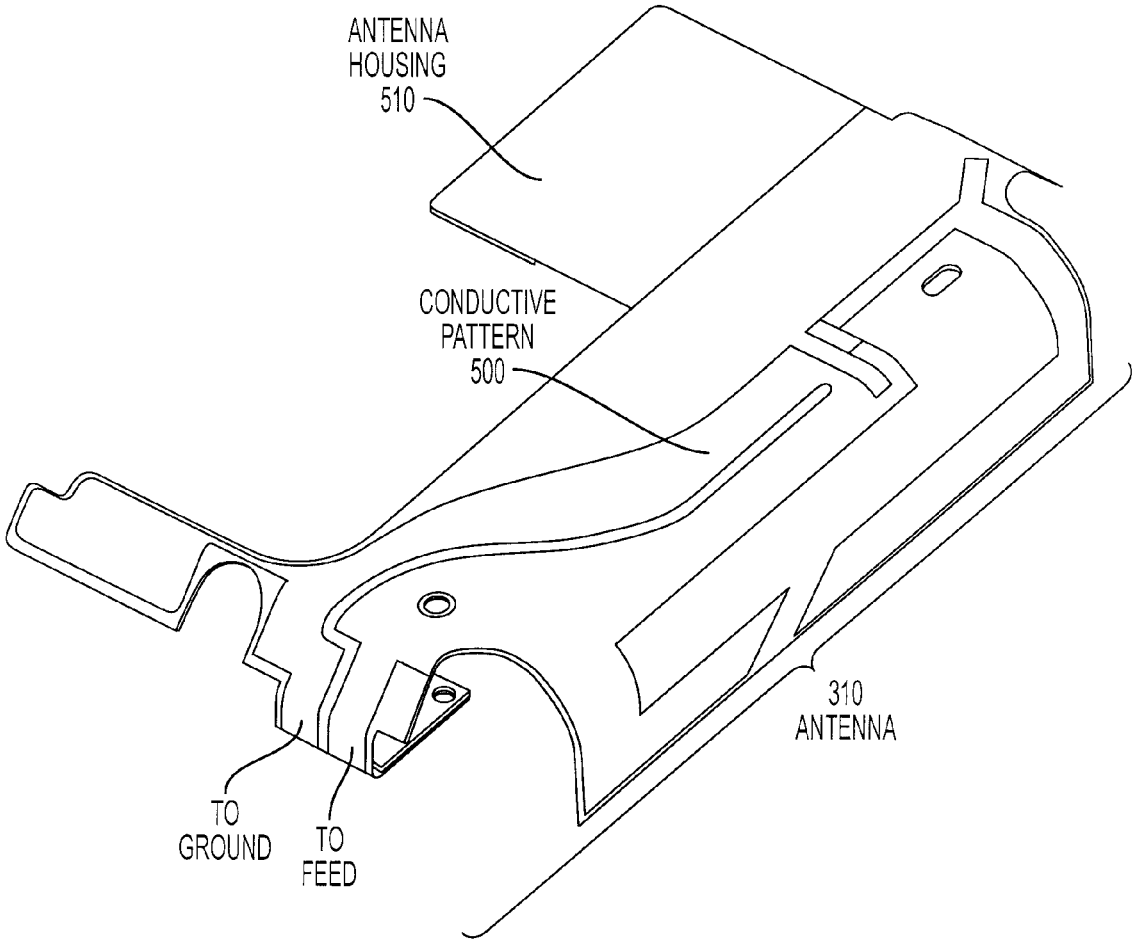
FIGS. 5 and 6 illustrate an exemplary physical configuration of the antenna of FIG. 3.
Figure 6:
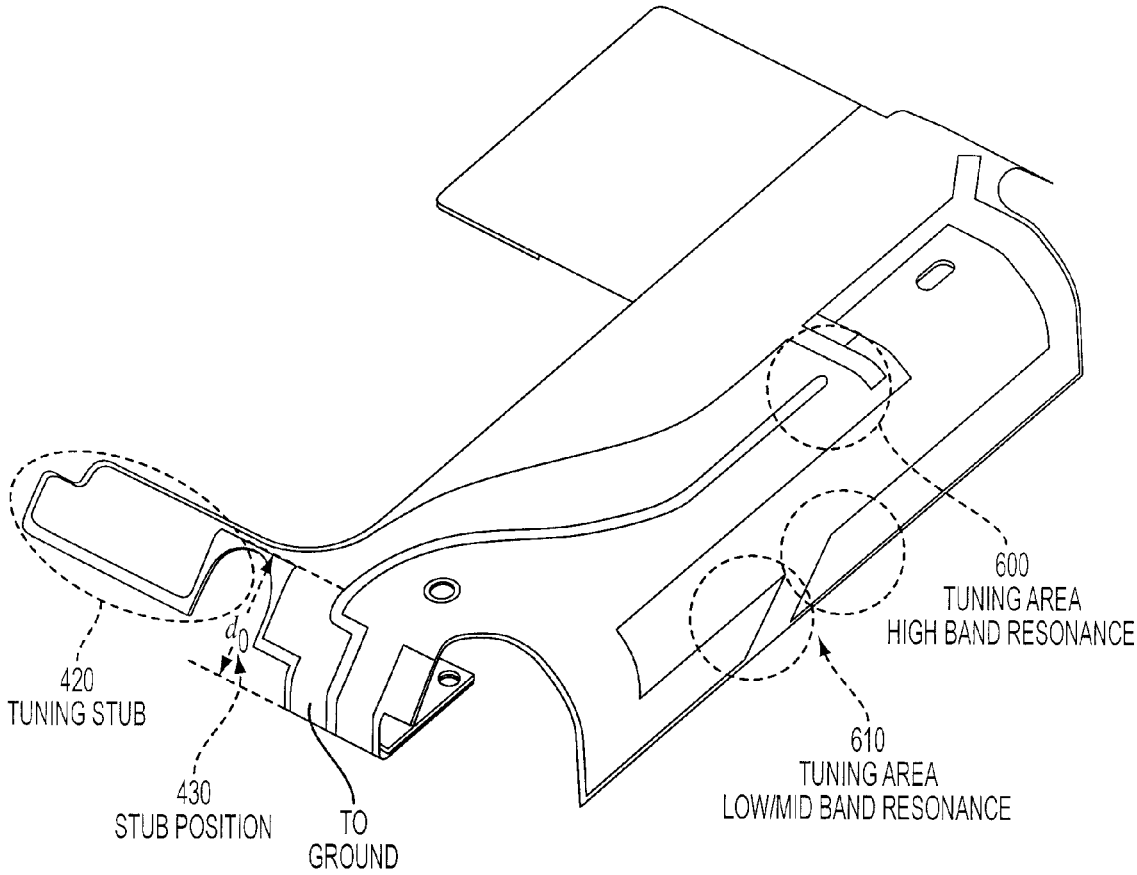

FIG. 5 illustrates a physical configuration of antenna 310 according to one exemplary implementation. In the exemplary implementation of FIG. 5, antenna 310 includes a PIFA antenna where a conductive pattern 500 is formed on an antenna housing 510. FIG. 5 additionally depicts conductive pattern 500 having a connection to ground and to the antenna "feed." As further shown in FIG. 6, tuning stub 420 includes a section of conductive material that connects to conductive pattern 500 at a stub position 430 that is a distance ($d_0$) from the ground connection. FIG. 6 additionally depicts areas of conductive pattern 500 that may also be used for tuning resonances of antenna 310. For example, a tuning area 600 is shown where the antenna designer may alter the pattern of conductive pattern 500 to tune the high-band resonance of antenna 310 (however, tuning in tuning area 600 may affect L+W, antenna matching and/or other resonances of antenna 310). Another tuning area 610 is shown where the antenna designer may alter the conductive pattern 500 to tune the low/mid band resonance of antenna 310 (however, tuning in tuning area 610 may affect L+W, antenna matching and/or other resonances of antenna 310).

Figure 7:
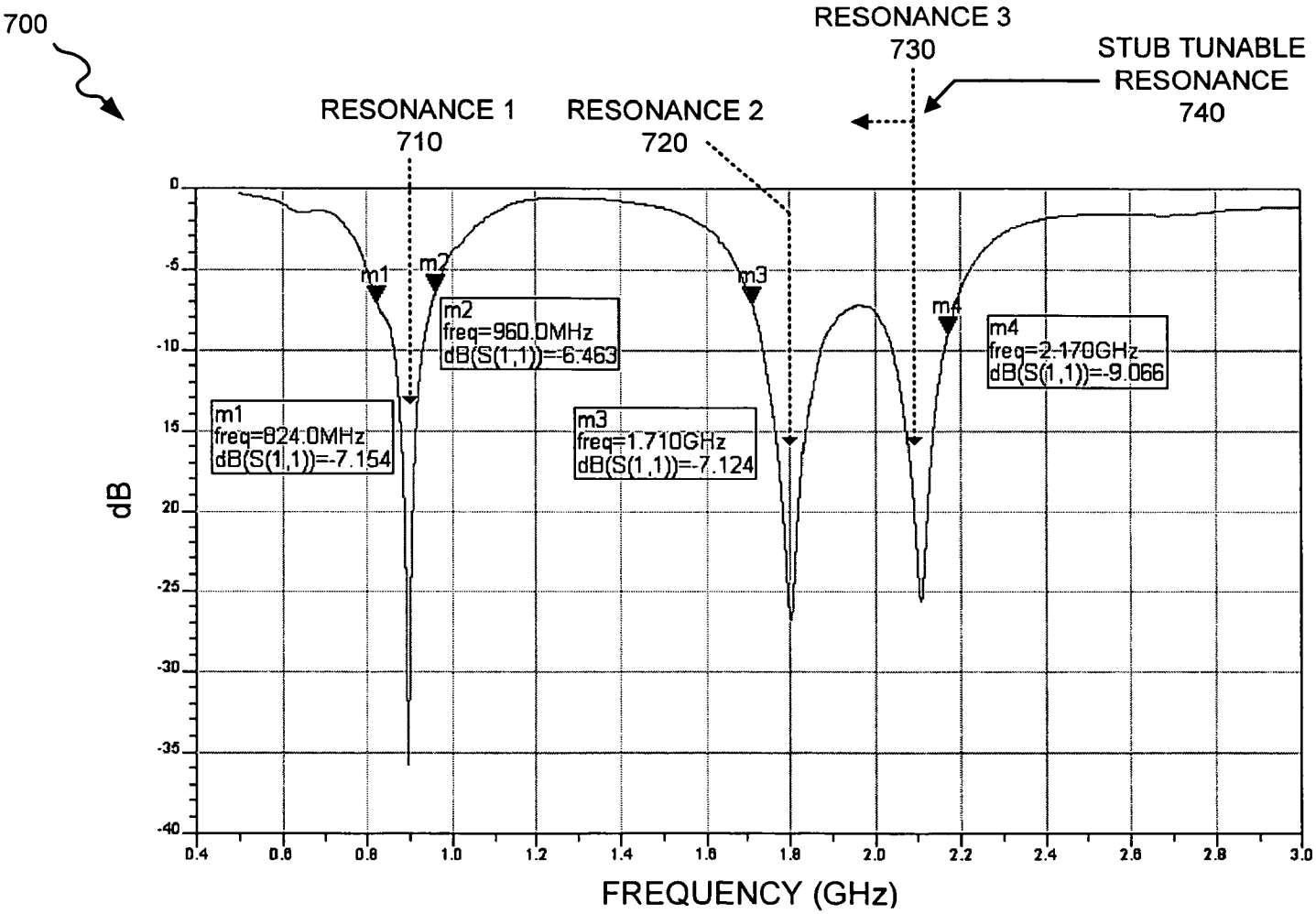
FIG. 7 is a diagram of a frequency response plot that depicts tuning of a high band resonance using the tunable stub of FIGS. 4A and 4B.

FIG. 7 illustrates an exemplary frequency response plot 700 of antenna 310 that includes three antenna resonances, resonance 1 710, resonance 2 720 and resonance 3 730, where resonance 3 730 may be a stub tunable resonance 740. As already discussed, tuning stub 420 of antenna 310 may be used to adjust resonance 3 730 towards lower frequencies independently of resonances 1 710 and 2 720. Adjustment of stub tunable resonance 740 may, thus, adjust resonance 3 730 without impacting resonances 1 710 and 2 720.

CONCLUSION

The foregoing description of implementations consistent with principles of the invention provides illustration and description, but is not intended to be exhaustive or to limit the invention to the precise form disclosed. Modifications and variations are possible in light of the above teachings, or may be acquired from practice of the invention. Aspects of the invention have been described as being implemented in mobile terminals, such as, for example, cellular phones. The principles of the invention as described herein, however, may be equally applied to any type of device that uses an antenna.

One skilled in the art will recognize that the principles of the present invention may be applied to any wired or wireless system utilizing any type of multi-access scheme, such as TDMA, CDMA or FDMA. It should be further understood that the principles of the present invention may be utilized in hybrid systems that are combinations of two or more of the above multi-access schemes. In addition, a communication device, in accordance with the present invention, may be designed to communicate with, for example, a base station transceiver using any standard based on GSM, TDMA, CDMA, FDMA, a hybrid of such standards or any other standard.

It will be apparent to one of ordinary skill in the art that aspects of the invention, as described above, may be implemented in many different forms of software, firmware, and hardware in the implementations illustrated in the figures. The actual software code or specialized control hardware used to implement aspects consistent with the principles of the invention is not limiting of the invention.

No element, act, or instruction used in the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. An antenna, comprising:

conductive material formed in a pattern on an antenna housing, where one end of the conductive material connects to a ground connection; and a tuning stub, having a length ($l_0$), connected to the conductive material at a distance ($d_0$) from the ground connection, where the distance ($d_0$) and the length ($l_0$) are adjusted to tune a resonance of the antenna, where the adjustment is neutral to antenna matching or effective two dimensional current flow on the antenna.

2. The antenna of claim 1, where the tuning stub comprises an open transmission line, having the length ($l_0$), connected to the conductive material at the distance ($d_0$) from the ground connection.

3. The antenna of claim 1, where the length ($l_0$) and/or distance ($d_0$) of the tuning stub may be adjusted to tune the resonance of the antenna to a lower frequency.

4. The antenna of claim 1, where the length ($l_0$) and distance ($d_0$) tune a high band resonance of the antenna without affecting other resonance bands of the antenna.

5. The antenna of claim 4, where the length ($l_0$) and distance ($d_0$) tune the high band resonance of the antenna.

6. The antenna of claim 1, where the antenna comprises a planar F-type antenna.

7. An apparatus, comprising:

a transceiver unit; and an antenna connected to the transceiver unit and to a ground connection, where the antenna includes a tunable stub, having a length ($l_0$), connected to the antenna at a distance ($d_0$) from the ground connection, where a value of the length ($l_0$) and a value of the distance ($d_0$) affect a high band resonance of the antenna and where the value of the length ($l_0$) and a value of the distance ($d_0$) are neutral to antenna matching or effective two dimensional current flow on the antenna.

8. The apparatus of claim 7, where the tunable stub comprises an open transmission line, having the length ($l_0$), connected to the antenna at the distance ($d_0$) from the ground connection.

9. The apparatus of claim 7, where the length ($l_0$) and/or distance ($d_0$) of the tunable stub may be adjusted to tune the high band resonance of the antenna to a lower frequency.

10. The apparatus of claim 7, where the antenna comprises a planar F-type antenna.

11. The apparatus of claim 7, where the apparatus comprises a cellular radiotelephone.

12. A method, comprising:

forming a conductive material formed in a pattern on an antenna housing, where one end of the conductive material connects to a ground connection; and forming a tuning stub, having a length ($l_0$) and including an open transmission line, connected to the conductive material at a distance ($d_0$) from the ground connection, where the distance ($d_0$) and length ($l_0$) can be adjusted to tune a high band resonance of the antenna, where the adjustment is neutral to antenna matching or effective two dimensional current flow on the antenna.

* * * * *